United States Patent [19]

Borgeas

[11] 4,223,457

[45] Sep. 23, 1980

[54] HEEL SHOCK ABSORBER FOR FOOTWEAR

[76] Inventor: Alexander T. Borgeas, 129 W. Catalina Dr., Phoenix, Ariz. 85013

[21] Appl. No.: 944,264

[22] Filed: Sep. 21, 1978

[51] Int. Cl.[2] ..... A43B 21/28; A43B 21/32

[52] U.S. Cl. ..... 36/35 B; 36/37

[58] Field of Search ..... 36/35 B, 29, 43, 44, 36/71, 37; 128/594; 35/35 B, 37, 29, 43, 44, 71

[56] References Cited

U.S. PATENT DOCUMENTS

| | | | |
|---|---|---|---|
| 545,705 | 9/1895 | MacDonald | 36/37 |
| 1,145,534 | 7/1915 | Wetmore | 128/594 |
| 1,211,806 | 1/1917 | Adams | 36/37 |
| 1,241,832 | 10/1917 | Druckenmiller | 128/594 |
| 1,667,939 | 5/1928 | Levy | 36/35 B |
| 1,771,793 | 7/1930 | Kind | 36/35 B |
| 2,477,588 | 8/1949 | Dumm | 128/594 |
| 4,063,562 | 12/1977 | Smith | 128/594 |

*Primary Examiner*—James Kee Chi

*Attorney, Agent, or Firm*—Warren F. B. Lindsley

[57] ABSTRACT

Heel supporting and cushioning member for footwear controlling the movement of foot/leg muscles in the form of removable, preferably disposable heel and foot shock absorber comprising a pliable coil filled with an elastomeric material resiliently flexing with the movement of the heel.

3 Claims, 11 Drawing Figures

HEEL SHOCK ABSORBER FOR FOOTWEAR

BACKGROUND OF THE INVENTION

This invention relates to footwear and more particularly to heel inserts which deform temporarily under heel-strike acting as a shock absorber and torque controller to aid in the prevention of ankle, knee, leg and tendon injuries during various physical activities.

Each foot contains, besides the bone structure, 19 muscles plus the tendons of 12 more muscles situated in the leg, more than a hundred ligaments, tough connective and protective layers of fascia and toe nails. It also contains yards of blood vessels and intricate networks of nerves.

A foot in action goes through three forward motions, namely heel impact, a transitional horizontal balance phase, and the thrust of the toes, to move the individual into a repetition by the opposite foot of the exhilarating rhythm the comprises walking.

Running and jogging intensifies that shock pressure and/or stress on the feet and particularly the heel since it is the heel, as noted from above, that first receives the weight of the body, i.e. heelstrike. Walking, running and exercising on a hard or inflexible surface aggravates foot problems since by nature the foot is intended to flex on impact with the ground. Thus, a new heel shock absorber is needed to reduce the harmful effects of the impact or heelstrike which transmits stress and biomechanical twisting to the foot, leg and the back muscles.

DESCRIPTION OF THE PRIOR ART

U.S. Pat. No. 545,705 discloses a cushioned sole for footwear which utilizes a pneumatic tubing coiled and secured beneath a foot bearing layer of leather.

U.S. Pat. No. 1,540,430 discloses a ventilated insole for footwear comprising a multiplicity of perforations in the forward half only of the insole.

U.S. Pat. No. 2,100,492 discloses an outer sole for a shoe comprising a plurality of lengths of hollow rubber tubing disposed in longitudinal continuous direct contact with each other.

U.S. Pat. No. 3,552,044 discloses a pad filled with elastomeric pellets or particles which will conform to irregularly shaped feet.

U.S. Pat. No. 3,589,037 discloses a removable foot supporting and cushioning liner for footwear constructed from a pair of laminated gas impervious sheets of thin, lightweight, plastic material having a multiplicity of separate gas filled pockets distributed over the supporting surface of the member.

SUMMARY OF THE INVENTION

This invention is directed to an insert which may be formed of polyester fibers having a coil, elastomerically filled tubular member anchored in and exposed on the heel engaging surface of the insert for use in the heel portion of various types of footwear. The tubular member is developed to resiliently flex under heelstrike and twisting movement of the heel of the user so as to provide foot and leg muscle comfort and protection particularly during physical activity such as walking, running, jogging or the like.

It is, therefore, one object of this invention to provide a new and improved heel shock absorber and biomechanical twisting controlling insert for footwear.

Another object of this invention is to provide new and improved inserts for the heels of various footwear employing a flexible, resilient tubular means embodied in the surface of the inserts for providing foot and leg muscle comfort and protection during physical activities.

A further object of this invention is to provide a new and improved heel insert for footwear embodying elastomeric materials in a tubular form inlayed in the heel engaging surface of the insert for not only absorbing the force of heelstrike but also controlling the twisting of the heel which causes the majority of ankle, knee, leg and tendon injuries.

A still further object of this invention is to provide a new and improved conveniently removable heel insert that provides shock absorbtion twist controlling movement of the foot and leg muscles and which is sanitary, lightweight and inexpensive when mass produced.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

In order to control the effects of heelstrike and biomechanical twisting that causes ankle, knee, leg and tendon injuries, a new insert for the heels of various footwear is disclosed. This insert embodies a coil filled with an elastomeric material which provides a resilient, flexible means for absorbing shock and controlling twisting which the prior art pneumatic coiled tubes failed to do since they failed to provide enough reaction to the forces applied to the heel and transmitted to the heel. Consequentially injuries continue to plague the human race particularly during running and other physical activities.

Figure 1:
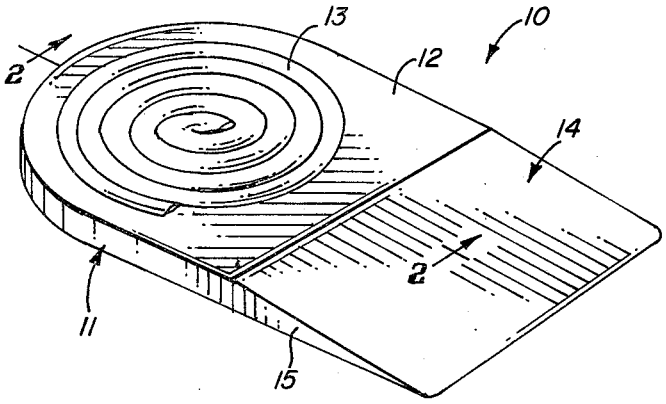
FIG. 1 is a perspective view of a heel insert for footwear and embodying the invention.

Referring more particularly to the drawings by characters of reference, FIG. 1 discloses an insert 10 for footwear with its size being scaled to fit the footwear involved. As noted from FIGS. 1 and 2 of the drawing, the insert comprises a cushioned pad formed of a suitable material such as a needled non-woven polyester fiberous product sold by Lydall, Inc. under the trademark UNISOCK. This insert comprises a relatively flat platform or pad portion 11 of a suitable thickness such as, for example, a quarter of an inch which has at least partially embedded in its relatively flat top surface 12 a coiled tubular member 13. A second portion 14 of the insert for positioning in the footwear toward the toe end of a shoe comprises a wedged shaped configuration 15.

Figure 2:
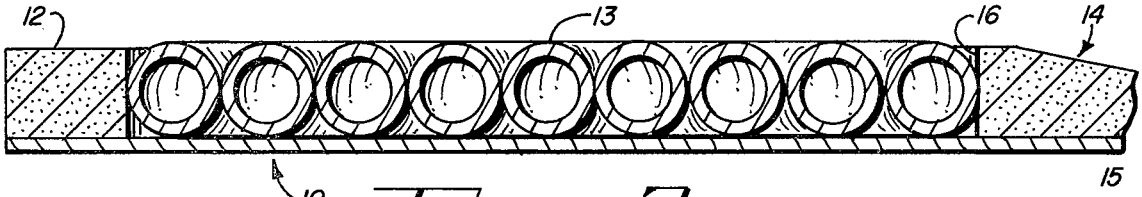
FIG. 2 is a cross-sectional view of FIG. 1 taken along the line 2—2.

FIG. 2 illustrates that the insert 10 may be provided with an opening 16 extending through portion 11 with one side of the insert covered along its length by a felt, leather, plastic or other suitable material 17. Although portions 11 and 14 of insert 10 may be formed of any suitable material, felt, foam rubber, plastic or the like, the UNISOCK material is preferable since it provides the strength to retain its form when tubular member 13 filled with a suitable elastomeric material such as corn syrup is deformed under impact and twisting action of the heel. Elastomeric pellets comprising Shell Chemical Corporation's "Thermoplastic" comprising a butadienestyrene copolymer having a durometer reading of about 45 Shore A may also be used as a filler in the tubular member 13. It should be noted that all elastomeric material used assumes its original condition quickly after heel pressure is removed therefrom. These pellets may be coated with a silicone grease if so desired such as Dow Corning No. 7 lubricant.

As further shown in FIGS. 1 and 2, the tubular member 13 may snugly fit into the circular or other configuration type of opening 16 in portion 10 of insert 10. It may be flush with or arranged to protrude slightly therefrom so that the pressure of the wearer of the footwear would essentially feel the total surface 12 of the insert with its center portion providing a more deformable portion than the remainder of the top surface of the insert.

Figure 3:
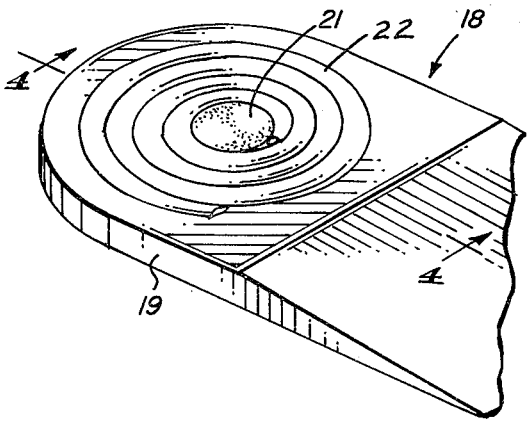
FIG. 3 is a partial perspective view of a modification of the heel insert shown in FIGS. 1 and 2.
Figure 4:
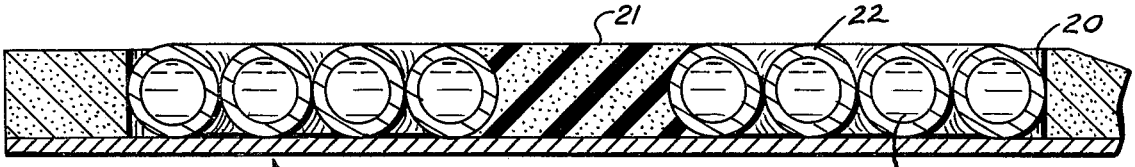
FIG. 4 is a cross-sectional view of FIG. 3 taken along the line 4—4.
Figure 5:
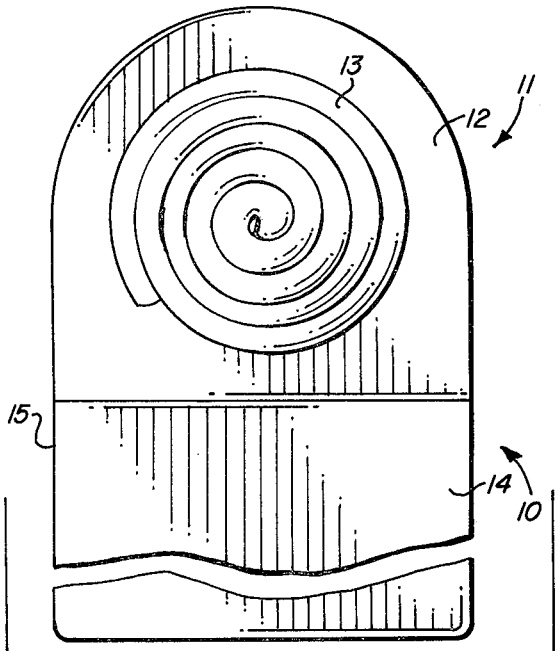
FIG. 5 is a top view of FIG. 1.

FIGS. 3 and 4 illustrate a modification of the insert shown in FIGS. 1 and 2 wherein insert 18 differs from insert 10 essentially in the configuration of portion 19 thereof. All other like portions of the insert are provided with the same reference characters as used in FIGS. 1 and 2. Portion 19 of insert 18 is provided with a circular or other geometrical type opening 20 the center of which contains an insert 21 around which is coiled a suitable resilient tubular member 22. This insert 21 is intended to form a core in the center of opening 20 which forms a resilient but firm center for the insert, the top of which lies substantially flush with the heel bearing surface of the insert. It is intended to fall within the scope of this invention to place the insert in the center but within the outline of the opening below the heel engaging surface of the insert, if so desired. Tubular member 22 is shown as being filled with a resilient material 23 such as the elastomeric material described above under the discussion of FIGS. 1 and 2 or corn syrup or other fluid material having elastic characteristics.

Figure 6:
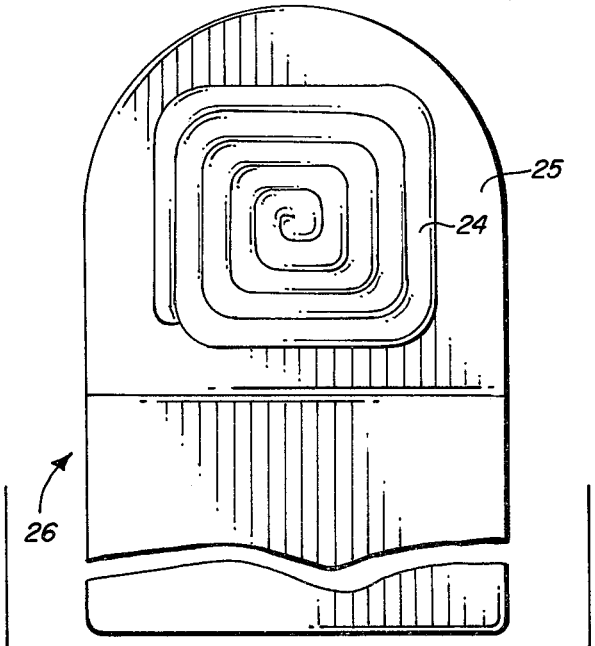
FIG. 6 is a top view of a modification of the coil configuration of the resilient tubular member shown in FIGS. 1–5 inserted in the heel insert.

FIG. 6 illustrates a further modification of the inserts shown in FIGS. 1–5 wherein non-cylindrical elongated resilient hollow member 24 is coiled to cover most of the heel engaging surface 25 of insert 26. This coil may be suitably secured to the top surface 25 of insert 26 or arranged in a cavity in the surface 25 of the insert in the same general manner that coils 13 and 22 are inserted into the inserts 10 and 18 of FIGS. 1–5. As shown, the cross-sectional configuration may be rectangular, square or any other suitable geometrical shape.

Figure 7:
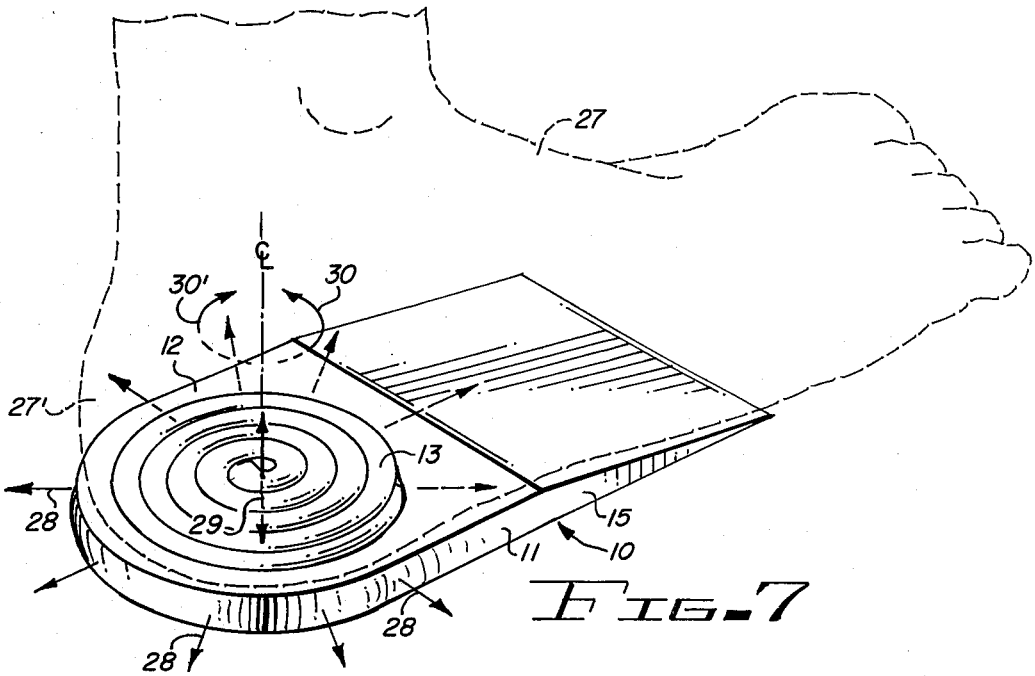
FIG. 7 is a perspective view of the insert shown in FIG. 1 illustrating the forces conveyed by heelstrike as well as the bio-mechanical twisting forces of the foot absorbed by the tubular, elastomeric filled inlayed coil.

FIG. 7 illustrates in more detail the forces absorbed by the insert 10 and particularly the tubular member 13. As shown, when a user's foot 27 and particularly its heel 27' strikes in a relatively perpendicular manner, as illustrated by the arrow 29, the tubular member 13, the force of the heelstrike is transmitted through the tubular member 13 and the side walls of the opening 16 radially to the periphery of the insert as shown by the arrows 28. This force is absorbed by the footwear within which the insert 10 is positioned.

Any torque applied by the heel to the tubular member is also absorbed and substantially dissipated by the coiled configuration of the tubular member. Such torque is illustrated by the arcuate arrows 30 and 30'.

Figure 8A:
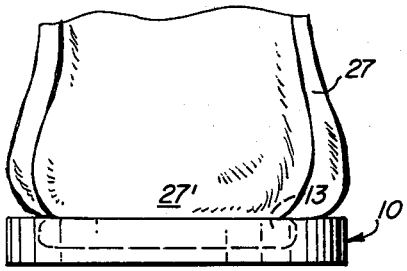
FIG. 8A is a rear view of the heel of the foot shown in dash lines in FIG. 7 illustrating a normal heel position.
Figure 8B:
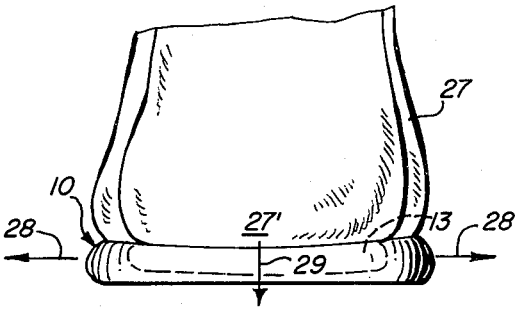
FIG. 8B is a view similar to FIG. 8A illustrating a downward thrust on the insert.

FIG. 8A illustrates the heel of a foot exerting normal pressure on insert 10 when housed within a shoe or other suitable footwear. FIG. 8B illustrates the insert deflecting under downward thrust or heelstrike of the foot.

Figure 9:
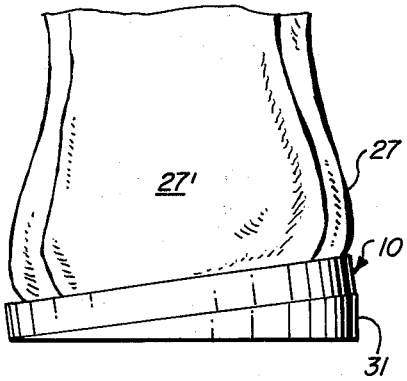
FIG. 9 is a view similar to FIG. 8A illustrating the use of a wedge together with the insert of FIGS. 1 and 7 extending inwardly from the outside of the foot.
Figure 10:
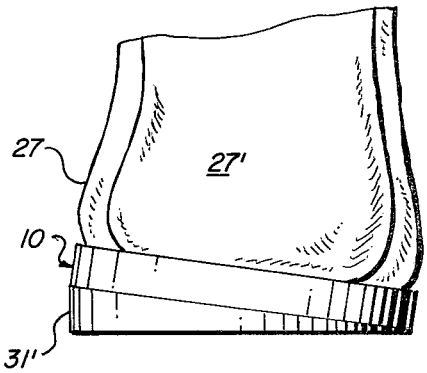
FIG. 10 is a view similar to FIG. 9 illustrating the wedge extending inwardly from the inside of the foot.

FIGS. 9 and 10 illustrate the use of corrective wedges 31 and 31' in combination with the insert 10 for insertion from the left and right position of the insert.

It should also be noted that the insert may be positioned in a shoe rotated 180 degrees, or turned upside down, if so desired.

Although but a few embodiments of the invention have been illustrated and described, it will be apparent to those skilled in the art that various changes and modifications may be made therein without departing from the spirit of the invention or from the scope of the appended claims.

What is claimed is:

1. An insert for covering the heel position of footwear comprising:

a pad portion, said pad portion comprising a relatively flat heel engageable member having an aperture formed therein, a resilient tubular member positioned in said aperture in said flat heel engageable member in a coiled configuration, said tubular member comprises a hollow configuration filled with an elastomeric material and positioned in said aperture to be substantially flush with the surface of said heel engaging member, a circular plug mounted in the center of said aperture having its heel engaging portion substantially flush with the heel engaging surface of said flat heel engageable member, and said tubular member being coiled around said circular plug, whereby when heelstrike of a user is applied to said tubular member, it momentarily distorts under the impact and returns to its initial position when the force is at least partially removed thereby serving as a shock and torque absorber.

2. The insert set forth in claim 1 wherein:

said aperture is substantially circular in shape.

3. The insert set forth in claim 1 wherein:

said tubular configuration is rectangular in cross-sectional configuration.

* * * * *